United States Patent [19]

Kennedy

[11] 4,094,435

[45] June 13, 1978

[54] PULL TAB BEVERAGE CAN OPENER

[76] Inventor: Clyde Kennedy, 2524 E. Main St., Stockton, Calif. 95205

[21] Appl. No.: 844,277

[22] Filed: Oct. 21, 1977

[51] Int. Cl.[2] ..... B65D 41/32

[52] U.S. Cl. ..... 220/269; 220/270; 220/271

[58] Field of Search ..... 220/269, 270, 271, 272, 220/273

[56] References Cited

U.S. PATENT DOCUMENTS

| | | | |
|---|---|---|---|
| 3,420,398 | 1/1969 | Chun | 220/269 |
| 3,442,416 | 5/1969 | Nicholson | 220/269 |
| 3,653,535 | 4/1972 | Brown | 220/269 |
| 3,847,300 | 11/1974 | Waters | 220/269 |

*Primary Examiner*—George T. Hall
*Attorney, Agent, or Firm*—Roger B. Webster

[57] ABSTRACT

A beverage can opener which comprises—in combination with the top of a metallic beverage can—a hinged-end tear strip defined on said top by scoring thereof, a hinged-end tear flap defined on said top by scoring thereof, the tear strip and tear flap being spaced diametrically on the can top, an initially separate finger-engageable, ring-form pull tab connected to the tear strip exteriorly of and initially flush with the can top, and an initially separate tension strap connected between the tear strip and the tear flap internally of the can and initially flush with the underside of the can top; sequential manual lifting of and pulling motion on the pull tab severing said tear strip, except at one end providing a hinge, from the can top whereby a vent is formed in said can top; such motion—at the same time and as a transmitted force imposed by the tension strap on the tear flap—severing said tear flap, except at one end providing a hinge, from the can top and bending such tear flap into the can, thus producing a drinking and pouring opening in the can top without any metallic projection therefrom at or adjacent such opening.

10 Claims, 4 Drawing Figures

PULL TAB BEVERAGE CAN OPENER

BACKGROUND OF THE INVENTION

1. Field of the Invention

This invention relates to improvements in manually operative opening devices as used in connection with the top of a metallic beverage can. Certain of the known devices for the purpose include a hinged-end tear flap formed by scoring the can top in a manner whereby—by finger depression thereon from above—the tear flap (except an unscored portion which provides a hinge) is torn from the can top and finger-depressed downwardly into the can to produce a pouring or drinking opening. The advantage of bending the tear flap into the can resides in the fact that there is no throw-away part to harm the ecology, nor any outwardly projecting part—at or adjacent such formed opening—which could conceivably cause physical injury to the user. However, certain disadvantages outweigh the mentioned advantages in that—when the tear flap is finger-depressed into the can—there is the risk of cutting the finger on the raw metallic edge which surrounds a major portion of the formed opening, and—additionally—insertion of the finger into such formed opening, and hence into the can, may cause contamination to the contents of such can. The present invention was conceived in a successful effort to provide a pull tab beverage can opener which—while retaining such advantages—overcomes the described disadvantages.

2. The Prior Art

U.S. Pat. Nos. 3,301,434; 3,420,398; 3,618,815; 3,653,535; 3,908,856; 3,952,914 and 4,015,744 represent the most relevant prior art known to applicant.

The above prior art—considered singly or together—does not anticipate, nor suggest as obvious, the particular structure of the herein-claimed pull tab beverage can opener, and applicant has no knowledge of any prior art disclosing such particular structure.

SUMMARY OF THE INVENTION

The present invention provides, as a major object, a beverage can opener which comprises—in combination with the top of a metallic beverage can—a hinged-end tear strip defined on said top by scoring thereof, a hinged-end tear flap defined on said top by scoring thereof, the tear strip and tear flap being spaced diametrically on the can top, an initially separate finger-engageable, ring-form pull tab connected to the tear strip exteriorly of and initially flush with the can top, and an initially separate tension strap connected between the tear strip and the tear flap internally of the can and initially flush with the underside of the can top; sequential manual lifting of and pulling motion on the pull tab severing said tear strip, except at one end providing a hinge, from the can top whereby a vent is formed in said can top; such motion—at the same time and as a transmitted force imposed by the tension strap on the tear flap—severing said tear flap, except at one end providing a hinge, from the can top and bending such tear flap into the can, thus produces a drinking and pouring opening in the can top without any metallic projection therefrom at or adjacent such opening.

The present invention provides, as a still further object, a beverage can opener which is designed for ease and economy of manufacture, and convenience and safety in use.

The present invention provides, as a still further object, a practical, reliable, and durable beverage can opener, and one which is exceedingly effective for the purpose for which it is designed.

DE

DESCRIPTION OF THE PREFERRED EMBODIMENT

Figure 1:
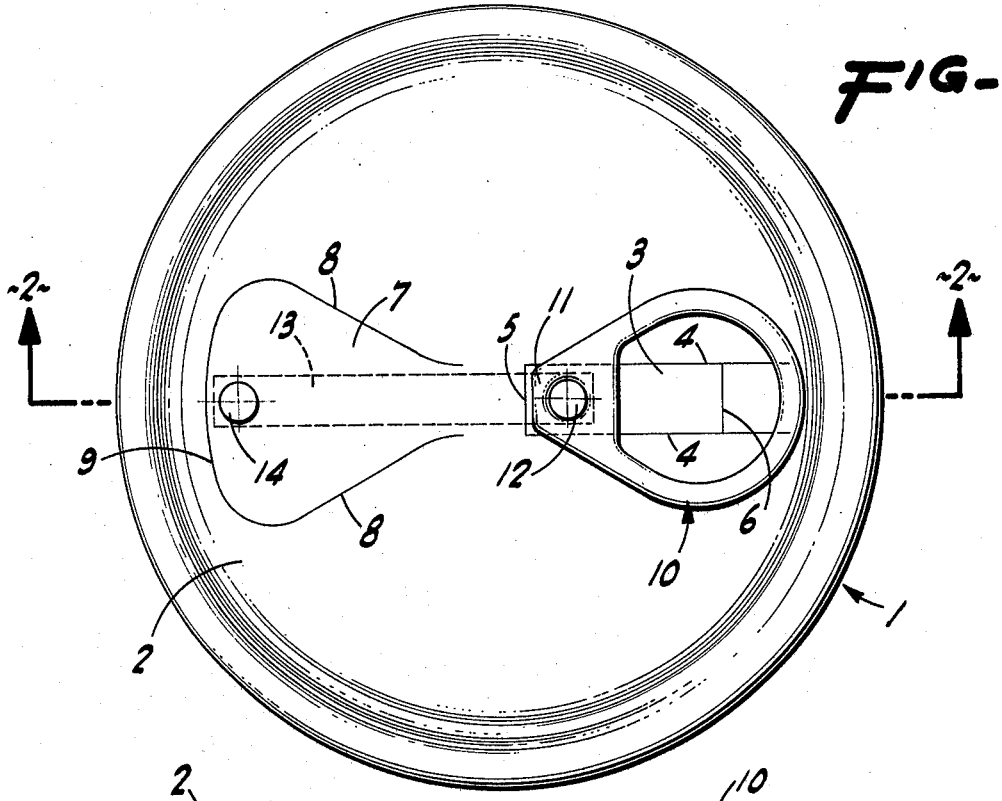
FIG. 1 is an enlarged plan view showing the top, on a beverage can, provided with the present pull-tab-type opener.
Figure 2:
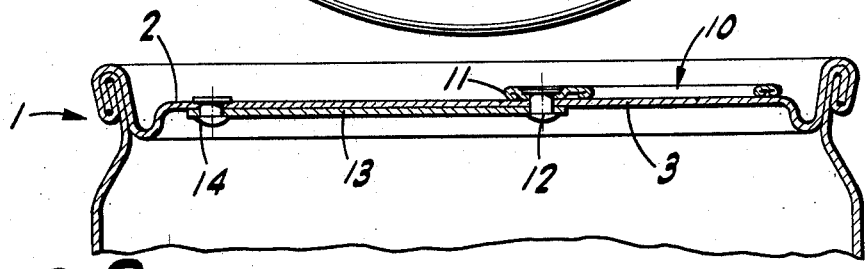
FIG. 2 is a diametral sectional elevation taken substantially on line 2—2 of FIG. 1; the view showing—on the can top—the parts of the opener in their initial positions, and the can being shown only in part.

Referring now more particularly to the drawings and to the characters of reference marked thereon, the present invention is embodied in combination with a beverage can 1 having a top 2; such top 2 being of a thin, lightweight metal capable of being manually torn or ruptured along pre-scored lines on such top.

On one side thereof, the can top 2 is formed with a radially extending, elongated, rectangular but relatively narrow, tear strip 3 defined by side lines 4 and a transverse inner end line 5 pre-scored in said can top. Intermediate its ends, the tear strip 3 is slightly indented on the upper surface and in a transverse line indicated at 6, for the purpose to later appear.

On the opposite side and in diametrically spaced relation to the tear strip 3, the can top 2 is formed with a somewhat heart-shaped, radially extending, tear flap 7 which narrows to its inner end; such tear flap 7 being defined by side lines 8 and an outer end line 9 pre-scored in said can top.

A flat pull tab 10, in ring form, is disposed initially flush on the can top 2 in overlying relation to the tear strip 3; such pull tab 10 including an inner end neck 11 directly above the inner end of said tear strip 3 and affixed thereto by a vertical, pressure-tight, leak-proof rivet 12.

A substantially radially extending, elongated rectangular but relatively narrow tension strap 13 initially lies flush with the underside of the can top 2; such tension strap 13 being connected at its inner end to the underside of the inner end of the tear strip 3 by the rivet 12. At its outer end, the tension strap 13 is connected to the underside of the outer end of the tear flap 7 by a vertical, pressure-tight, leak-proof rivet 14.

Figure 3:
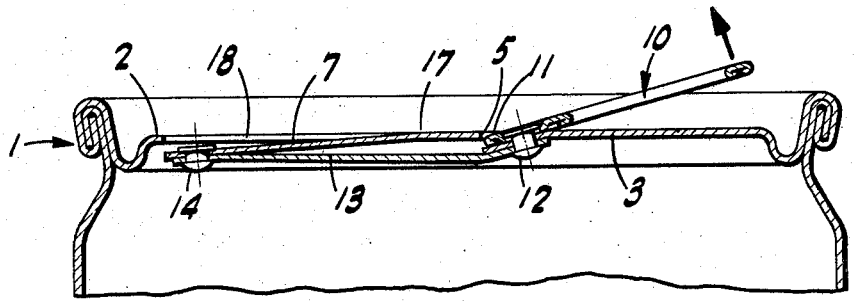
FIGS. 3 and 4 disclose the progressive positions of the parts of the opener during and upon opening of the can.

In use of the above-described pull tab beverage can opener, the ring-form pull tab 10 is first finger-engaged and lifted a short distance in the direction indicated by the arrow in FIG. 3, and to an inclined position as illustrated. Upon occurrence of such lifting motion, the neck 11 of the pull tab 10 depresses the inner end portion of the tear strip 3 sufficient to downwardly rupture said inner end portion of the tear strip 3 from the can top 2.

Figure 4:
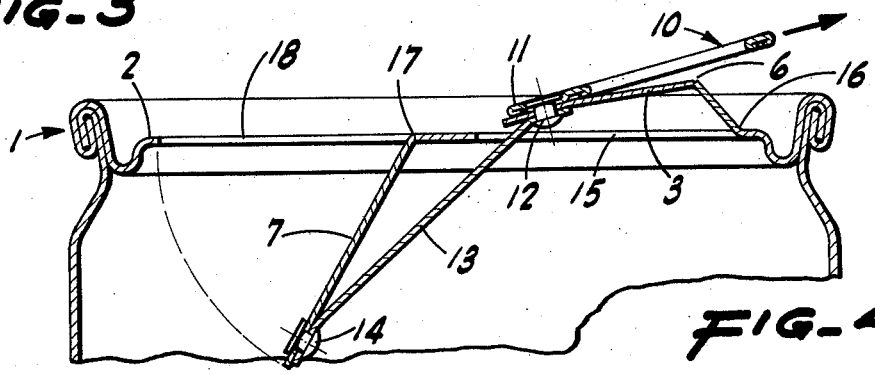

Thereafter, the pull tab 10 is relatively forcefully manually pulled radially outwardly and upwardly in the direction indicated in FIG. 4. This causes the tear strip 3, except at its outer end, to rupture from the can top 2 and which provides a desirable and effective vent opening 15 in the can top. Upon the tear strip 3 being thus ruptured from the can top 2, such tear strip 3 is foreshortened and—with the connected outer end providing a hinge as at 16—buckles upwardly as shown in FIG. 4 and as enhanced by the indented transverse line 6. If it be desired that the tear strip instead buckle downwardly, the indented transverse line is formed (not shown) on the underside of the tear strip.

Simultaneously with the pull tab 10 being manually lifted and then pulled radially outwardly and upwardly as above described, a corresponding longitudinally inward force and movement is imparted to the tension strap 13 and transmitted to the tear flap 7. This causes the tear flap 7, except at its inner end, to rupture from the can top 2 and bend downwardly into the can 1, with the connected inner end of such tear flap 7 providing a hinge as at 17. See FIG. 4. Upon the tear flap 7 being so bent downwardly into the can, a drinking or pouring opening 18 is formed in the can top; this without the need, and avoiding the attendant disadvantages hereinbefore described, of finger engagement and pressure directly on the tear flap 7 from above. This not only assures of sanitation and convenience of use, but provides a pull tab beverage can opener which is environmentally acceptable and satisfies governmental requirements in that there are no throwaway parts. Further, the opener is entirely recyclable with the can.

From the foregoing description, it will be readily seen that there has been produced such a pull tab beverage can opener as substantially fulfills the objects of the invention, as set forth herein.

While this specification sets forth in detail the present and preferred construction of the pull tab beverage can opener, still in practice such deviations from such detail may be resorted to as do not form a departure from the spirit of the invention as defined by the appended claims.

I claim:

1. A beverage can opener comprising—in combination with the top of a metallic beverage can—a hinged-end tear strip defined on said top by scoring thereof, a hinged-end tear flap defined on said top by scoring thereof, the tear strip and tear flap being spaced but alined on the can top, a finger-engageable pull tab connected to the tear strip exteriorly of the can top, and a tension strap connected between the tear strip and the tear flap internally of the can; pulling motion on the pull tab severing said tear strip, except at one end providing a hinge, from the can top whereby a vent is formed in said can top, and such motion—at the same time and as a transmitted force imposed by the tension strap on the tear flap—severing said tear flap, except at one end providing a hinge, from the can top and bending such tear flap into the can, thus producing a drinking and pouring opening in the can top.

2. A beverage can opener, as in claim 1, in which the pull tab is connected to the tear strip exteriorly of and initially flush with the can top, and the tension strap is connected between the tear strip and the tear flap internally of the can and initially flush with the underside of the can top.

3. A beverage can opener, as in claim 1, in which the tear strip and the tear flap each include inner and outer ends; the tension strap being connected at one end to the inner end of the tear strip, and connected at the other end to the outer end of the tear flap.

4. A beverage can opener, as in claim 3, in which the connection between the tension strap and the tear strip includes a rivet; such rivet also providing the connection between the pull tab and said tear strip.

5. A beverage can opener, as in claim 1, in which the tear strip and the tear flap are spaced diametrically on the can top and each includes an inner and an outer end; the outer end of the tear strip being its hinged end, and the inner end of the tear flap being its hinged end; the tension strap spanning, and being connected, between the inner end of the tear strip and the outer end of the tear flap.

6. A beverage can opener, as in claim 5, in which the pull tab is connected to said inner end of the tear strip.

7. A beverage can opener, as in claim 5, including rivets which connect the tension strap at its ends to the tear strip and the tear flap.

8. A beverage can opener, as in claim 7, in which the rivet which connects the tension strap to the tear strip also connects the latter to the pull tab.

9. A beverage can opener, as in claim 1 in which the pull tab is of ring-form and disposed initially flush with the can top in overlying relation to the tear strip; the pull tab including a neck, said neck being connected to one end of the tear strip exteriorly of said can top, and a related end of the tension strap being connected to said one end of the tear strip internally of the can.

10. A beverage can opener, as in claim 1, in which the tear strip and tear flap are spaced diametrically on the can top, and the pull tab being connected to the end of the tear strip adjacent the tear flap, and the other end of the tear strip being its hinged end.

* * * * *